US010144616B2

(12) United States Patent
Hsu et al.

(10) Patent No.: US 10,144,616 B2
(45) Date of Patent: Dec. 4, 2018

(54) CAB FOR VERTICAL TRAVEL WITH CONTROLLABLE ORIENTATION FOR NON-VERTICAL TRAVEL

(71) Applicant: Otis Elevator Company, Farmington, CT (US)

(72) Inventors: Arthur Hsu, South Glastonbury, CT (US); Tadeusz Pawel Witczak, Bethel, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 28 days.

(21) Appl. No.: 15/179,512

(22) Filed: Jun. 10, 2016

(65) Prior Publication Data

US 2017/0355565 A1 Dec. 14, 2017

(51) Int. Cl.

| | |
|---|---|
| ***B66B 11/00*** | (2006.01) |
| ***B66B 11/02*** | (2006.01) |
| ***B66B 3/00*** | (2006.01) |
| ***B66B 9/00*** | (2006.01) |

(52) U.S. Cl.

CPC ..... *B66B 11/0226* (2013.01); *B66B 3/00* (2013.01); *B66B 9/003* (2013.01); *B66B 11/0206* (2013.01)

(58) Field of Classification Search

CPC .. B66B 9/003; B66B 11/0206; B66B 11/0226
See application file for complete search history.

(56) References Cited

U.S. PATENT DOCUMENTS

| | | | | |
|---|---|---|---|---|
| 2,052,690 | A | 11/1936 | Austin | |
| 3,495,545 | A | 2/1970 | Zeloko et al. | |
| 3,698,326 | A | 10/1972 | Eugem et al. | |
| 4,059,194 | A * | 11/1977 | Barry | B61B 1/005 414/278 |
| 4,113,064 | A * | 9/1978 | Shigeta | B66B 1/34 187/251 |
| 4,693,186 | A | 9/1987 | Alphonse | |

(Continued)

FOREIGN PATENT DOCUMENTS

| | | | |
|---|---|---|---|
| FR | 2610956 | A1 | 8/1988 |
| GB | 2131760 | A | 6/1984 |

(Continued)

OTHER PUBLICATIONS

European Search Report Issued in EP Application No. 17175317.1, dated Oct. 25, 2017, 9 Pages.

*Primary Examiner* — Joseph A Dillon, Jr.
(74) *Attorney, Agent, or Firm* — Cantor Colburn LLP

(57) ABSTRACT

A transportation system for a building includes a horizontal travel lane, a vertical travel lane, and a transportation cab configured for travel along the horizontal travel lane and vertical travel lane, a cab floor of the transportation cab orientable such that the cab floor is non perpendicular to a gravitational force acting on the transportation cab. A method of operating a transportation system for a building includes locating a transportation cab at a travel lane positioned at a building, accelerating the transportation cab in a non-vertical direction along the travel lane and orienting a cab floor of the transportation cab to be non-perpendicular to a gravitational force acting on the transportation cab during non-vertical acceleration of the transportation cab.

15 Claims, 6 Drawing Sheets

(56) References Cited

U.S. PATENT DOCUMENTS

| | | | | |
|---|---|---|---|---|
| 4,821,845 | A | 4/1989 | Deviaris | |
| 5,368,132 | A * | 11/1994 | Hollowell | B66B 1/30 187/393 |
| 5,492,201 | A * | 2/1996 | Ericson | B66B 7/06 187/401 |
| 5,660,249 | A | 8/1997 | Powell et al. | |
| 6,095,926 | A * | 8/2000 | Hettema | A63G 31/16 104/85 |
| 6,334,511 | B1 * | 1/2002 | Araki | B66B 1/30 187/380 |
| 6,354,404 | B1 * | 3/2002 | Sansevero | B66B 9/003 187/249 |
| 6,431,078 | B2 | 8/2002 | Serrano | |
| 6,792,872 | B1 * | 9/2004 | Valdespino | A63G 31/16 104/112 |
| 6,934,603 | B1 * | 8/2005 | Kochanneck | B25J 9/08 318/587 |
| 6,959,787 | B2 | 11/2005 | Husmann | |
| 7,984,684 | B2 * | 7/2011 | Hinderks | B63B 1/28 114/274 |
| 8,978,831 | B2 * | 3/2015 | Shilpiekandula | B66B 7/06 187/254 |
| 2001/0020429 | A1 | 9/2001 | Serrano | |
| 2005/0167207 | A1 * | 8/2005 | Fujita | B66B 1/425 187/401 |
| 2006/0204347 | A1 * | 9/2006 | Waldbauer | B60T 7/20 410/156 |
| 2008/0035439 | A1 * | 2/2008 | Fox | B62K 25/04 188/275 |
| 2009/0064890 | A1 * | 3/2009 | Charrere | B61B 1/02 104/89 |
| 2011/0067939 | A1 * | 3/2011 | Takenaka | B62K 1/00 180/21 |
| 2012/0055367 | A1 * | 3/2012 | Zayas | B61B 3/00 104/88.01 |
| 2014/0255137 | A1 * | 9/2014 | Haertel | B60P 1/52 414/529 |
| 2015/0096485 | A1 * | 4/2015 | Morice, III | B63B 27/10 114/259 |
| 2015/0136525 | A1 * | 5/2015 | May | A62B 1/02 182/142 |
| 2015/0307324 | A1 * | 10/2015 | King | B66B 9/00 187/249 |
| 2015/0368068 | A1 * | 12/2015 | Widmer | B66B 7/068 187/264 |
| 2016/0071418 | A1 * | 3/2016 | Oshida | G08G 1/22 701/23 |
| 2016/0288000 | A1 * | 10/2016 | McVeen | A63G 21/12 |
| 2017/0113682 | A1 * | 4/2017 | Kelly | B60W 30/025 |
| 2018/0050887 | A1 * | 2/2018 | Hall | B66B 13/303 |

FOREIGN PATENT DOCUMENTS

| | | | |
|---|---|---|---|
| JP | 04191282 | A | 7/1992 |
| JP | 3091587 | A | 6/1994 |
| JP | 3151581 | A | 7/1994 |
| JP | 11263553 | | 9/1999 |
| JP | 3059005 | B2 | 7/2000 |
| JP | 2000185885 | A | 7/2000 |
| JP | 2004035139 | A | 2/2004 |
| JP | 2010126341 | A | 6/2010 |
| KR | 100214670 | | 9/1999 |
| KR | 100271022 | B1 | 11/2000 |
| KR | 100275574 | B1 | 11/2000 |
| WO | 9118820 | A1 | 12/1991 |
| WO | 2008136692 | | 11/2008 |
| WO | 2009125253 | A1 | 11/2009 |

* cited by examiner

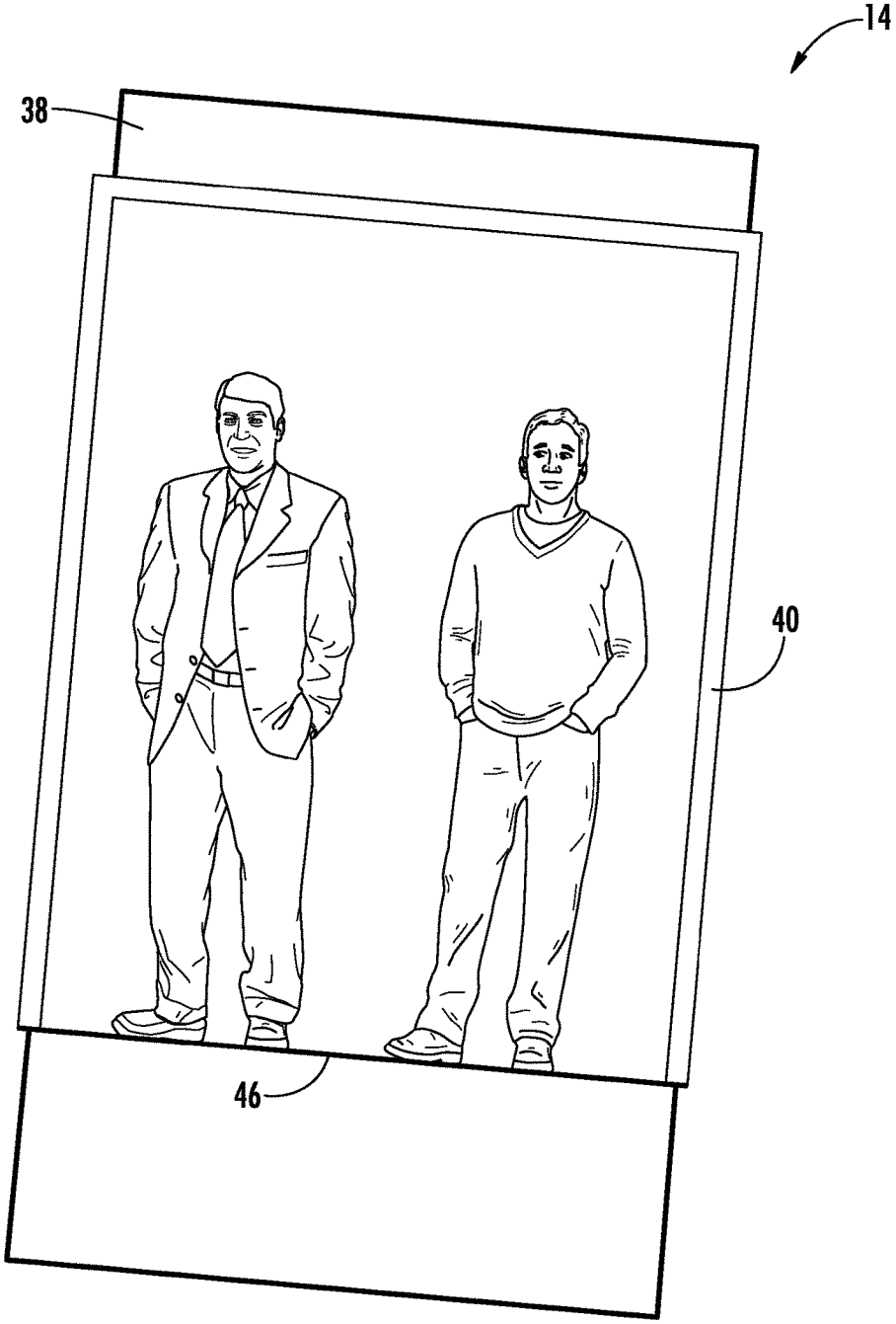
FIG. 6
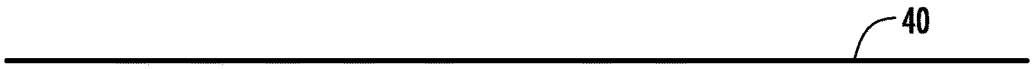

CAB FOR VERTICAL TRAVEL WITH CONTROLLABLE ORIENTATION FOR NON-VERTICAL TRAVEL

BACKGROUND

The subject matter disclosed herein relates generally to the field of transportation systems, and more particularly to transportation systems configured for both vertical and non-vertical travel.

In typical transportation systems, such as elevators, the systems are configured for only travel in a vertical direction, only upward or downward along a hoistway. In some systems, cars can be transferred between hoist ways at a transfer station, travelling horizontally for short distances without passengers in the cars.

The system may also include horizontal or other non-vertical travel lanes along which the traveling cars may move. Horizontal or non-vertical passenger travel within a building or a campus is desirable, although typical cars are not intended or configured for this purpose, and non-vertical accelerations are small given that passengers may be unaccustomed to significant lateral accelerations.

SUMMARY

In one embodiment, a transportation system for a building includes a horizontal travel lane, a vertical travel lane, and a transportation cab configured for travel along the horizontal travel lane and vertical travel lane, a cab floor of the transportation cab orientable such that the cab floor is non perpendicular to a gravitational force acting on the transportation cab.

Additionally or alternatively, in this or other embodiments the cab floor is orientable such that the cab floor is perpendicular to a direction of a resultant acceleration force acting on the transportation cab.

Additionally or alternatively, in this or other embodiments the transportation cab includes an outer cab and an inner cab located at least partially inside of the outer cab, the inner cab including the cab floor.

Additionally or alternatively, in this or other embodiments the inner cab is rotatable relative to the outer cab to orient the cab floor non perpendicular to the gravitational force.

Additionally or alternatively, in this or other embodiments the cab floor is movable relative to the inner cab to orient the cab floor non perpendicular to the gravitational force.

Additionally or alternatively, in this or other embodiments the transportation cab is rotatable relative to a horizontal direction to orient the cab floor non perpendicular to the gravitational force.

Additionally or alternatively, in this or other embodiments a notification system provides an alert to a passenger in the transportation cab when the transportation cab changes travel direction.

Additionally or alternatively, in this or other embodiments one or more overhead handholds or seats are located in the transportation cab for passenger use.

In another embodiment, a transportation cab for a transportation system includes a cab floor, and an orientation system to orient the cab floor non perpendicular to a gravitational force acting on the transportation cab during non-vertical travel of the transportation cab.

Additionally or alternatively, in this or other embodiments the transportation cab includes an outer cab and an inner cab located at least partially insider of the outer cab, the inner cab including the cab floor.

Additionally or alternatively, in this or other embodiments the inner cab is rotatable relative to the outer cab to orient the cab floor non perpendicular to the gravitational force.

Additionally or alternatively, in this or other embodiments a motor is located at the outer cab and operably connected to the inner cab to rotate the inner cab relative to the outer cab.

Additionally or alternatively, in this or other embodiments the cab floor is movable relative to the inner cab to orient the cab floor non perpendicular to the gravitational force.

Additionally or alternatively, in this or other embodiments a notification system provides an alert to a passenger in the transportation cab when the transportation cab changes travel direction, and/or is about to start or stop travel.

Additionally or alternatively, in this or other embodiments one or more overhead handholds or seats are located in the transportation cab for passenger use.

In yet another embodiment, a method of operating a transportation system for a building includes locating a transportation cab at a travel lane positioned at a building, accelerating the transportation cab in a non-vertical direction along the travel lane and orienting a cab floor of the transportation cab to be non-perpendicular to a gravitational force acting on the transportation cab during non-vertical acceleration of the transportation cab.

Additionally or alternatively, in this or other embodiments the cab floor is oriented horizontally when the transportation cab reaches a constant non-vertical velocity.

Additionally or alternatively, in this or other embodiments the cab floor is oriented in a first direction during acceleration of the transportation cab in a non-vertical direction and the cab floor is oriented in a second direction different from the first direction during deceleration of the transportation cab.

Additionally or alternatively, in this or other embodiments orienting the cab floor non perpendicular to the gravitational force includes rotating an inner cab relative to an outer cab, the inner cab including the cab floor and disposed at least partially inside the outer cab.

Additionally or alternatively, in this or other embodiments orienting the cab floor non perpendicular to the gravitational force includes tilting the cab floor inside of an inner cab or the transportation cab.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

FIG. 6 is a schematic illustration of yet another embodiment of a transportation cab during non-vertical acceleration.

DETAILED DESCRIPTION

Figure 1:
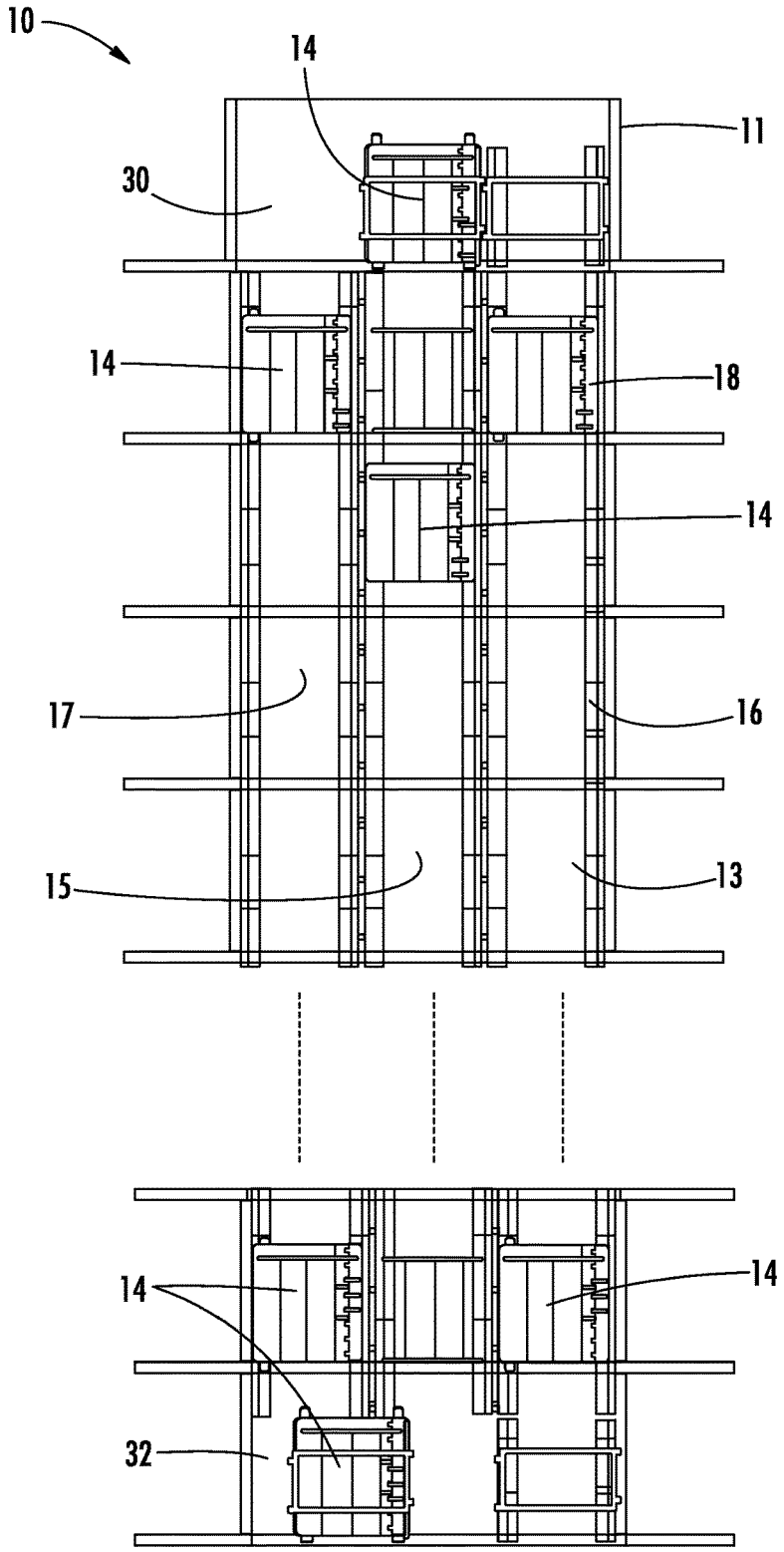
FIG. 1 depicts a multicar elevator system in an exemplary embodiment.

FIG. 1 depicts a transportation system 10 in an exemplary embodiment. Transportation system 10 includes a hoistway 11 having a plurality of lanes 13, 15 and 17. While three lanes are shown in FIG. 1, it is understood that embodiments may be used with multicar, ropeless transportation systems may have any number of lanes. In each lane 13, 15, 17, transportation cabs 14 travel in one direction, i.e., up or down. For example, in FIG. 1 transportation cabs 14 in lanes 13 and 15 travel up and transportation cabs 14 in lane 17 travel down. One or more transportation cabs 14 may travel in a single lane 13, 15, and 17.

Above the top floor is an upper transfer station 30 to impart horizontal motion to elevator cars 14 to move transportation cabs 14 between lanes 13, 15 and 17. It is understood that upper transfer station 30 may be located at the top floor, rather than above the top floor. Below the first floor is a lower transfer station 32 to impart horizontal motion to transportation cabs 14 to move transportation cabs 14 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and lower transfer station 32.

In one embodiment, transportation cabs 14 are propelled using a linear motor system having a primary, fixed portion 16 attached to each lane 13, 15, 17 and a secondary, moving portion 18 attached to the transportation cabs 14. The primary portion 16 includes windings or coils mounted at one or both sides of the lanes 13, 15 and 17. Secondary portion 18 includes permanent magnets mounted to one or both sides of cars 14. Primary portion 16 is supplied with drive signals to control movement of cars 14 in their respective lanes along rails 12 extending along the hoistway 11.

While a linear motor system is disclosed herein, it is merely one example of a propulsion system for the transportation cabs 14. In other embodiments, other types of propulsion such as, for example, a magnetic screw system or a friction propulsion system may be utilized to propel the transportation cabs 14.

Figure 2:
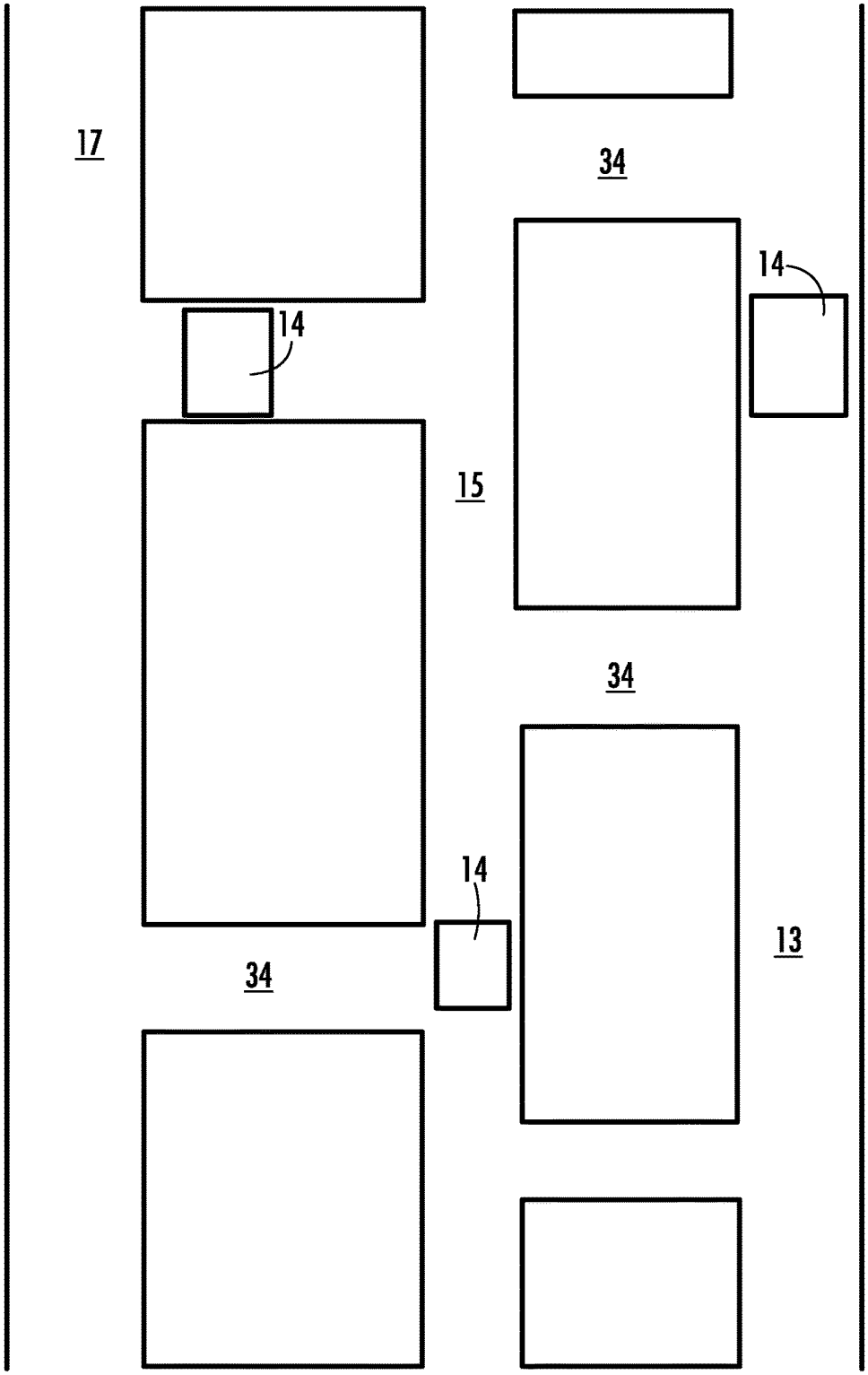
FIG. 2 is a schematic illustration of a transportation system including vertical and non-vertical travel lanes.

Referring now to FIG. 2, in addition to transfer stations 30, 32, the transportation system 10 may include non-vertical travel lanes 34 to move transportation cabs 14 across a building 36 and/or between two or more buildings 36. The non-vertical travel lanes 34 may be, for example, horizontal, linearly angled relative to the horizontal, curvilinear, or some combination thereof. The present disclosure introduces features to the transportation system 10 to allow for conveyance of passengers comfortably in both vertical and non-vertical directions.

Figure 3:
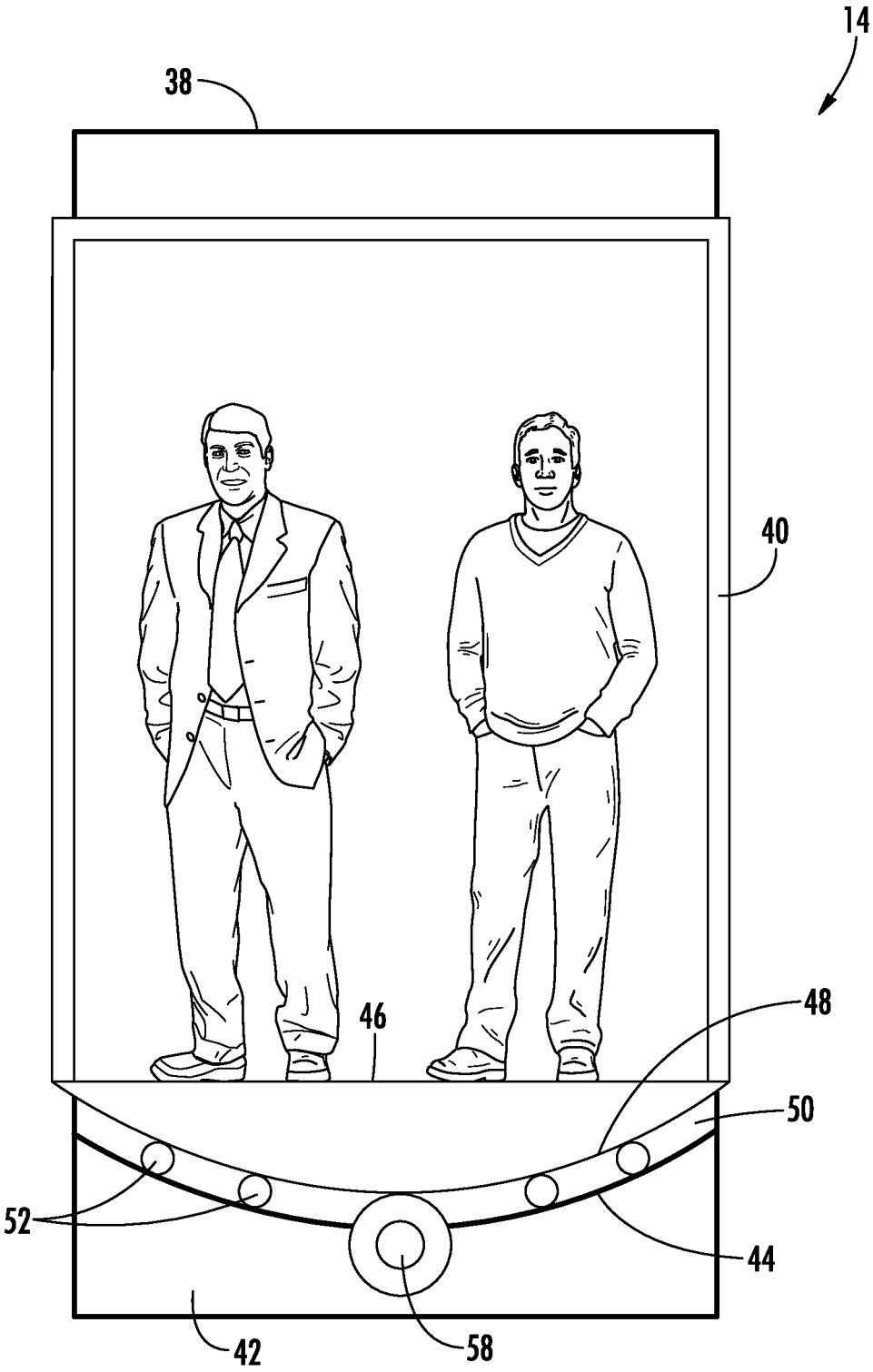
FIG. 3 is a schematic illustration of an embodiment of a transportation cab configured for vertical travel.

One embodiment of a transportation cab 14 will now be described with reference to FIGS. 3 and 4. In FIG. 3, transportation cab 14 is shown configured and aligned for vertical travel along, for example, one of lanes 13, 15 or 17. The transportation cab 14 includes an outer cab 38 and an inner cab 40 located at the outer cab 38 and supported by the outer cab 38. The outer cab 38 includes a base 42 with a curvilinear base surface 44, which in some embodiments is concave. The inner cab 40 includes a cab floor 46 and a floor surface 48, which is curvilinear and in some embodiments, convex. The floor surface 48 is located radially offset from the base surface 44, and is configured such that a radial gap 50 between the floor surface 48 and the base surface 44 is substantially constant along a length of the floor surface 48. The radial gap 50 is maintained via one or more spacer elements, such as rollers 52, located between the base surface 44 and the floor surface 48. In FIG. 3, the transportation cab 14 is oriented for vertical travel, so the cab floor 46 is positioned horizontally.

Figure 4:
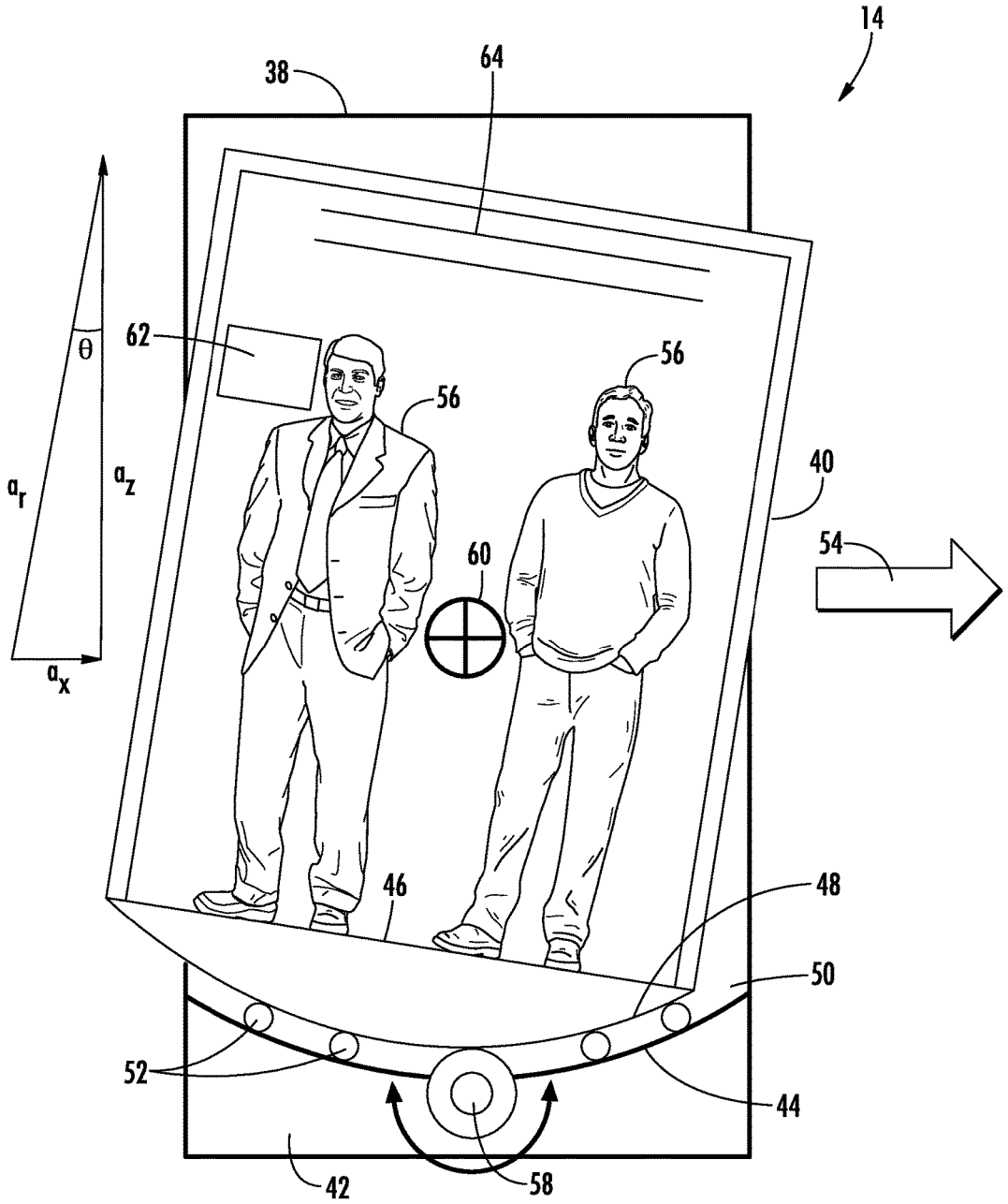
FIG. 4 is a schematic illustration of an embodiment of a transportation cab during non-vertical acceleration.

Referring now to FIG. 4, the transportation cab 14 is configured for travel in a non-vertical direction, for example, a horizontal direction 54. When the transportation cab 14 is moving, it is desired to maintain the cab floor 46 oriented perpendicular with forces acting on passengers 56 therein. During vertical motion, acceleration forces are aligned vertically so the cab floor 46 is oriented horizontally. On the other hand, when the transportation cab 14 is moved, for example, in the horizontal direction 54, the passengers 56 are subjected to a lateral acceleration force, $a_x$, as well as vertical acceleration, $a_z$, which is primarily the gravitational constant. The resultant acceleration force, $a_r$, acts at an angle θ from vertical, where θ is defined as:

$$\theta=\tan^{-1}(a_x/a_z)$$

The cab floor 46 is tilted by the angle θ so the cab floor 46 is perpendicular to the resultant acceleration force $a_r$. It is to be appreciated that tilt of angle up to θ, or even slightly over θ will be helpful in mitigating the effects of horizontal acceleration. One embodiment to accomplish tilt of the cab floor 46 is illustrated in FIG. 4. An orientation motor 58 is fixed to the outer cab 38 and operably connected to the inner cab 40 such that operation of the orientation motor 58 rotates the inner cab 40 relative to the outer cab 38 about an axis of rotation 60. The axis of rotation 60 may be a virtual pivot point as shown in FIG. 4, or alternatively may utilize a hinge (not shown) or other mechanism located at the axis of rotation 60. Rotation of the inner cab 40 relative to the outer cab 38 by angle θ in turn tilts the cab floor 46 by angle θ thus orienting the cab floor 46 perpendicular to the resultant force $a_r$. Tilting of the cab floor 46 to be perpendicular to the resultant force $a_r$ allows the passengers 56 to be transported laterally at significant accelerations (e.g. >100 mg) while standing comfortably and unsupported.

Figure 5:
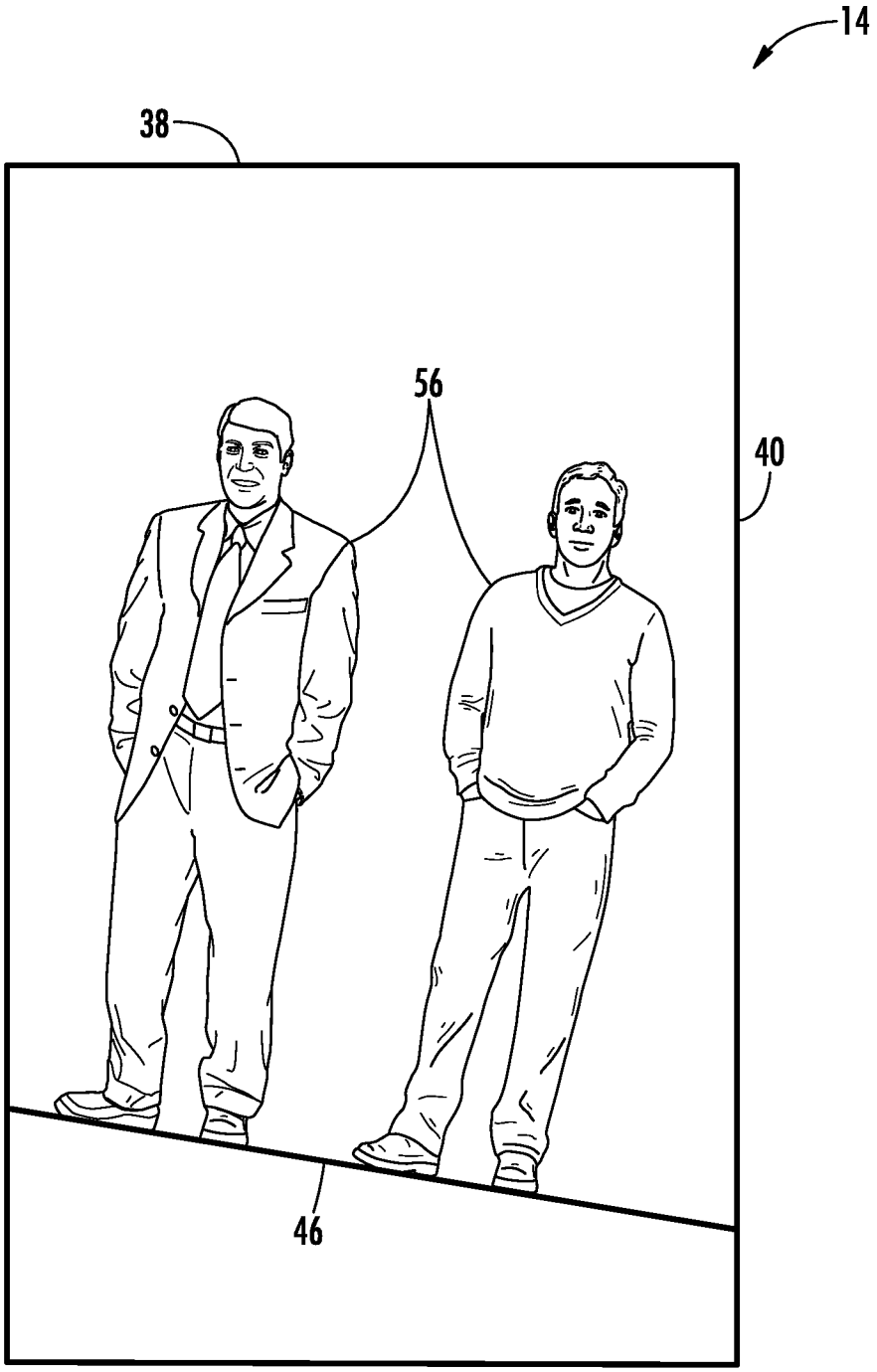
FIG. 5 is a schematic illustration of another embodiment of a transportation cab during non-vertical acceleration.

While in the embodiment of FIG. 4, the cab floor 46 is tilted by rotation of the inner cab 40 relative to the outer cab 38, one skilled in the art will readily appreciate that other configurations and structures may be utilized to tilt the cab floor 46. For example, as shown in the embodiment in FIG. 5, the inner cab 40 may be held stationary, while the cab floor 46 is tilted inside of the inner cab 40 via a motor (not shown) or other actuation device. In yet another embodiment, as shown in FIG. 6, the outer cab 38 and inner cab 40 may be rotated together to tilt the cab floor 46 relative to the horizontal direction 54.

Referring again to FIG. 4, when the transportation cab 14 is moved, for example, in the horizontal direction 54, the transportation cab 14 initially is accelerated in the horizontal direction 54 and the cab floor 46 is tilted as shown in FIG. 4. When the transportation cab 14 reaches a constant speed, or zero horizontal acceleration, the cab floor 46 may be returned to the horizontal orientation. Further, when the transportation cab 46 is decelerated, the cab floor 46 may tilt in a direction opposite to that shown in FIG. 4.

In some embodiments, to further enhance passenger comfort and safety, when the transportation cab 14 is about to change direction from vertical travel to non-vertical travel an alert may be provided to the passengers through a notification system 62, which in some embodiments includes a display to provide a message or light or other indicator in the transportation cab 14 and/or through an audible signal or message played in the transportation cab 14. Likewise, the alert may be provided when the transportation cab 14 changes direction from non-vertical travel to vertical travel, when the transportation cab 14 changes direction from a first vertical travel direction to a second vertical travel direction, and/or when the transportation cab 14 changes direction from a first non-vertical travel direction to a second non-vertical travel direction. Further, the alert may be provided in other operating situations, such as when the transportation cab is accelerated and/or decelerated.

In some embodiments, additional features are located in the transportation cab 14 to enhance passenger comfort and safety, mitigating effects of the non-vertical acceleration and/or deceleration. The features may include overhead handholds such as bars 64 or straps. In some embodiments, the transportation cab 14 may include one or more seats, such as a permanent or folding chair.

The transportation cab of the present disclosure enables passengers to be efficiently and comfortably transported both vertically and non-vertically. The transportation cab 14 further enhances passenger safety and comfort, while enabling non-vertical conveyance of passengers utilizing relatively high accelerations.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A transportation system for a building comprising:
- a horizontal travel lane;
- a vertical travel lane; and
- a transportation cab configured for travel along the horizontal travel lane and vertical travel lane, the transportation cab including:
  - an outer cab including a base with a curvilinear base surface;
  - an inner cab including a cab floor and a curvilinear floor surface radially offset from the base surface;
  - one or more spacer elements disposed between the base surface and the floor surface to maintain a constant radial gap therebetween; and
- an orientation system to orient the cab floor non perpendicular to a gravitational force acting on the transportation cab during non-vertical travel of the transportation cab by rotating the inner cab relative to the outer cab along an arc defined by the curvilinear floor surface.

2. The transportation system of claim 1, wherein the cab floor is orientable such that the cab floor is perpendicular to a direction of a resultant acceleration force acting on the transportation cab.

3. The transportation system of claim 1, wherein the cab floor is movable relative to the inner cab to orient the cab floor non perpendicular to the gravitational force.

4. The transportation system of claim 1, wherein the transportation cab is rotatable relative to a horizontal direction to orient the cab floor non perpendicular to the gravitational force.

5. The transportation system of claim 1, further comprising a notification system to provide an alert to a passenger in the transportation cab when the transportation cab changes travel direction.

6. The transportation system of claim 1, further comprising one or more overhead handholds or seats disposed in the transportation cab for passenger use.

7. A transportation cab for a transportation system, comprising:
- an outer cab including a base with a curvilinear base surface;
- an inner cab including a cab floor and a curvilinear floor surface radially offset from the base surface;
- one or more spacer elements disposed between the base surface and the floor surface to maintain a constant radial gap therebetween; and
- an orientation system to orient the cab floor non perpendicular to a gravitational force acting on the transportation cab during non-vertical travel of the transportation cab by rotating the inner cab relative to the outer cab along an arc defined by the curvilinear floor surface.

8. The transportation cab of claim 7, further comprising a motor disposed at the outer cab and operably connected to the inner cab to rotate the inner cab relative to the outer cab.

9. The transportation cab of claim 7, wherein the cab floor is movable relative to the inner cab to orient the cab floor non perpendicular to the gravitational force.

10. The transportation cab of claim 7, further comprising a notification system to provide an alert to a passenger in the transportation cab when the transportation cab changes travel direction, and/or is about to start or stop travel.

11. The transportation cab of claim 7, further comprising one or more overhead handholds or seats disposed in the transportation cab for passenger use.

12. A method of operating a transportation system for a building, comprising:
- disposing a transportation cab at a travel lane disposed at a building, the transportation cab including:
  - an outer cab including a base with a curvilinear base surface;
  - an inner cab including a cab floor and a curvilinear floor surface radially offset from the base surface;
  - one or more spacer elements disposed between the base surface and the floor surface to maintain a constant radial gap therebetween;
- accelerating the transportation cab in a non-vertical direction along the travel lane; and
- orienting a cab floor of the transportation cab to be non-perpendicular to a gravitational force acting on the transportation cab during non-vertical acceleration of the transportation cab by rotating the inner cab relative to the outer cab along an arc defined by the curvilinear floor surface.

13. The method of claim 12, further comprising, orienting the cab floor horizontally when the transportation cab reaches a constant non-vertical velocity.

14. The method of claim 12, further comprising:
- orienting the cab floor in a first direction during acceleration of the transportation cab in a non-vertical direction; and
- orienting the cab floor in a second direction different from the first direction during deceleration of the transportation cab.

15. The method of claim 12, wherein orienting the cab floor non perpendicular to the gravitational force includes tilting the cab floor inside of an inner cab or the transportation cab.

* * * * *